US005860362A

United States Patent [19]

Smith

[11] Patent Number: 5,860,362

[45] Date of Patent: Jan. 19, 1999

[54] NEWSPAPER VENDING MACHINE WITH ONLINE CONNECTION

[75] Inventor: Graeme Smith, Barnhill, Scotland

[73] Assignee: NCR Corporation, Dayton, Ohio

[21] Appl. No.: 814,186

[22] Filed: Mar. 10, 1997

[30] Foreign Application Priority Data

Sep. 13, 1996 [GB] United Kingdom ..... 9619190

[51] Int. Cl.[6] ..... A47F 1/04

[52] U.S. Cl. ..... 101/494; 400/719; 379/91.01; 705/26; 221/309; 364/479.05

[58] Field of Search ..... 235/381, 379; 379/91.01, 91.12, 91.13; 400/719; 705/26; 221/154, 309; 101/494, 228; 364/479.05

[56] References Cited

U.S. PATENT DOCUMENTS

| | | | |
|---|---|---|---|
| 4,954,697 | 9/1990 | Kokubun et al. | 235/381 |
| 5,133,493 | 7/1992 | Russel et al. | 277/152 |
| 5,267,727 | 12/1993 | DeHority | 270/1.1 |
| 5,561,709 | 10/1996 | Remillard | 379/96 |

FOREIGN PATENT DOCUMENTS

| | | |
|---|---|---|
| 535 630 A2 | 4/1993 | European Pat. Off. . |
| 06-333156 | 12/1994 | Japan . |
| 7115474 | 5/1995 | Japan . |

*Primary Examiner*—Edgar Burr
*Assistant Examiner*—Dave A. Ghatt
*Attorney, Agent, or Firm*—Michael Chan

[57] ABSTRACT

A system which comprises a self-service newspaper vending machine (2) includes an electronic control means (34) with an on-line connection (36) to a news providing organization (38) from which a newspaper containing up to the minute news can be purchased. A customer is attracted by news stories shown on a display (6). The customer is then given the opportunity of purchasing a newspaper or part of a newspaper. Communication between the customer and the vending machine (2) is by the display (6) and a keyboard (8). The newspaper can be purchased by either inserting a banking or credit card in a card reader (52) or inserting coins into a coin slot (50). The vending machine (2) would then print out the up to the minute news requested.

11 Claims, 2 Drawing Sheets

NEWSPAPER VENDING MACHINE WITH ONLINE CONNECTION

BACKGROUND OF THE INVENTION

The present invention relates to a newspaper vending means.

At present newspapers can be purchased from various outlets such as retail establishments, newspaper vendors and vending machines. Regular deliveries need to be made to these outlets to keep them stocked with the latest issue of the newspaper. Even with regular deliveries, newspapers purchased from present outlets are to some extent out of date and may not contain, for example, the latest share prices, results of sporting events or the latest poll results of elections as they happen.

Of course newspaper vending machines, where the customer inserts his coins and then takes out a newspaper, are well known.

It is also known that terminals exist where users can access information and have it printed out where the terminal would have some form of electronic control means. Japanese Patent Application (Publication Number: 0711 5474A) describes a system, where more details on a news story can be received. A newspaper is purchased in the normal way. By each story on the newspaper there is a unique bar code. If the reader of the newspaper requires more information on a story, he needs to take the newspaper to a terminal with a bar code reader. The bar code is then read and the terminal displays details of that story in a multimedia format.

SUMMARY OF THE INVENTION

It is an object of this invention to provide a newspaper vending means from which newspapers containing up to the minute news can be purchased.

According to one aspect of the present invention there is provided a system comprising: a self-service newspaper vending machine which includes a housing in which is provided an opening and a payment accepting means, characterized by comprising a display means, an input means, printing means, delivery means to deliver printed sheets of paper to said opening, and electronic control means comprising data storage means, in which said electronic control means is connectable by an on-line connection to a news providing organization so as to update at intervals news items stored in the data storage means whereby a news item requested by said input means is retrieved from said data storage means, is printed on at least one sheet of paper, and delivered to said opening.

According to another aspect of the present invention there is provided a method for purchasing at least one printed sheet of news from a self-service newspaper vending machine, characterized by the steps of: receiving news items from an on-line connection; updating news items stored; receiving an input indicating at least one news item required; displaying the relevant cost; checking and accepting any payment made; printing the indicated at least one news item; and delivering the at least one printed news item to a customer.

BRIEF DESCRIPTION OF THE DRAWINGS

One embodiment of the invention will now be described by way of example with reference to the accompanying drawings in which.

DETAILED DESCRIPTION

Figure 1:
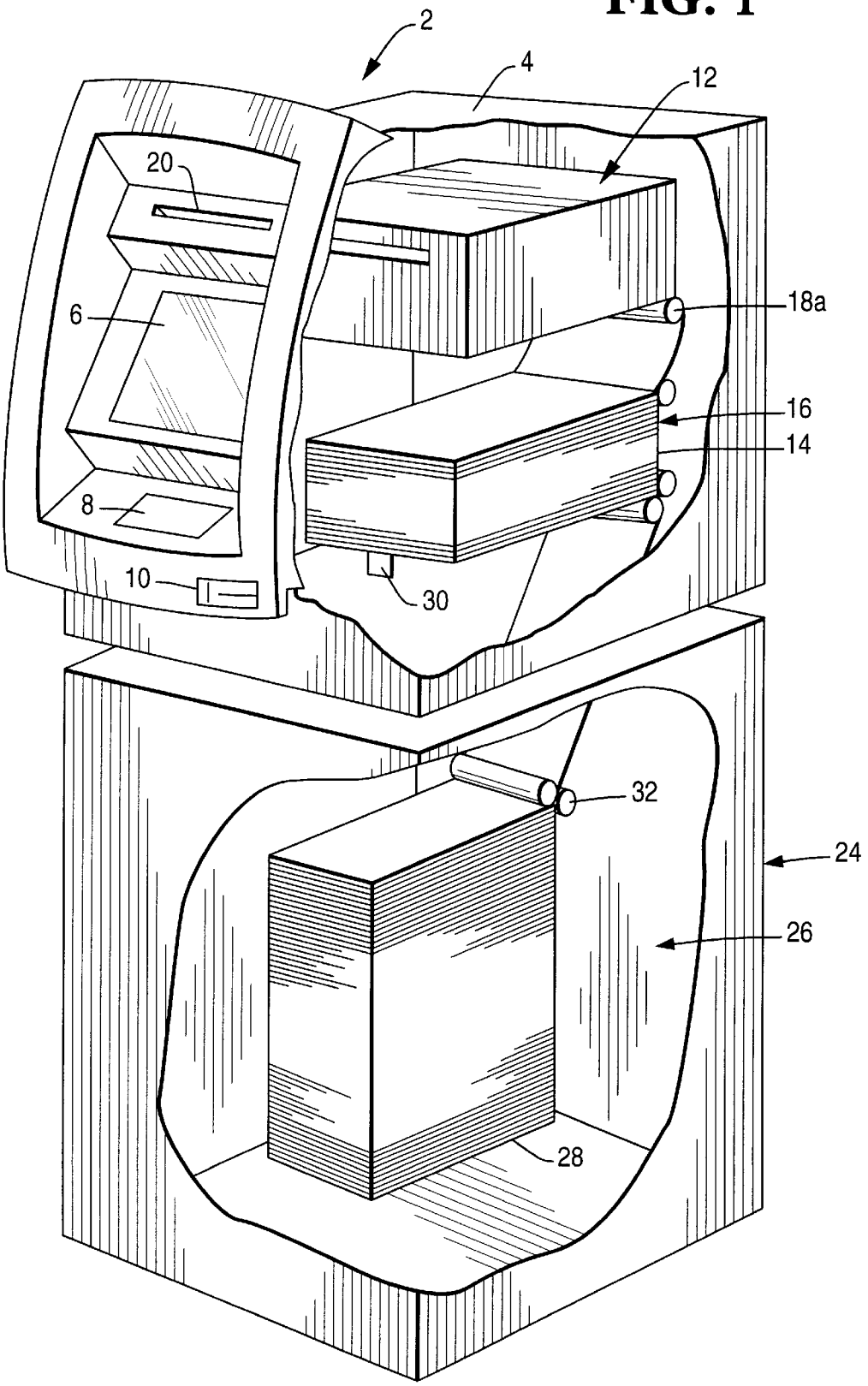
FIG. 1 is a cut-away schematic perspective view of a self-service newspaper vending machine in accordance with the invention, in which some of the components shown in FIG. 2 are omitted for the sake of clarity.

Referring now to FIG. 1, a self-service vending machine 2 is shown which includes a housing 4 in which is provided a display 6 on which can be displayed news headlines or stories or instructions as to how to operate the machine. There is also provided a keyboard 8 for a customer to communicate his response to any instructions, and payment slots 10 to accept coins or a magnetic card.

The customer can enter the requested news item via the keyboard 8 and the cost of the purchase is displayed on the display 6. The customer then inserts coins or some form of banking or credit card into the appropriate one of the payment slots 10. The vending machine 4 then checks by well known means (not shown) that the correct payment has been made.

Turning now to a more detailed description, within the housing 4 is a printer 12, a paper store 16 containing paper 14 and a feeder 18*a*. The printer 12 prints the whole newspaper or the part of the newspaper requested. The printed sheet or sheets is taken by a feeder 18*b* (FIG. 2) to an opening 20 in the housing 4 for collection by the customer.

Where more than one sheet is requested a bunching mechanism 22 (FIG. 2) which is connected to the printer 12 joins the sheets together and the feeder 18*b* then takes these to the opening 20.

The self-service newspaper vending machine 2 may be fixed to the top of a hollow pedestal 24. Inside the pedestal 24 is a storage area 26 for storing additional paper 28. A paper sensor 30 in the vending machine 2 detects when the paper 14 in the paper store 16 has run out. This sensor 30 then communicates to a feeder 32 in the pedestal to feed additional paper 28 through an opening in the top of the pedestal and the base of the housing 11 into the paper store 16.

Figure 2:
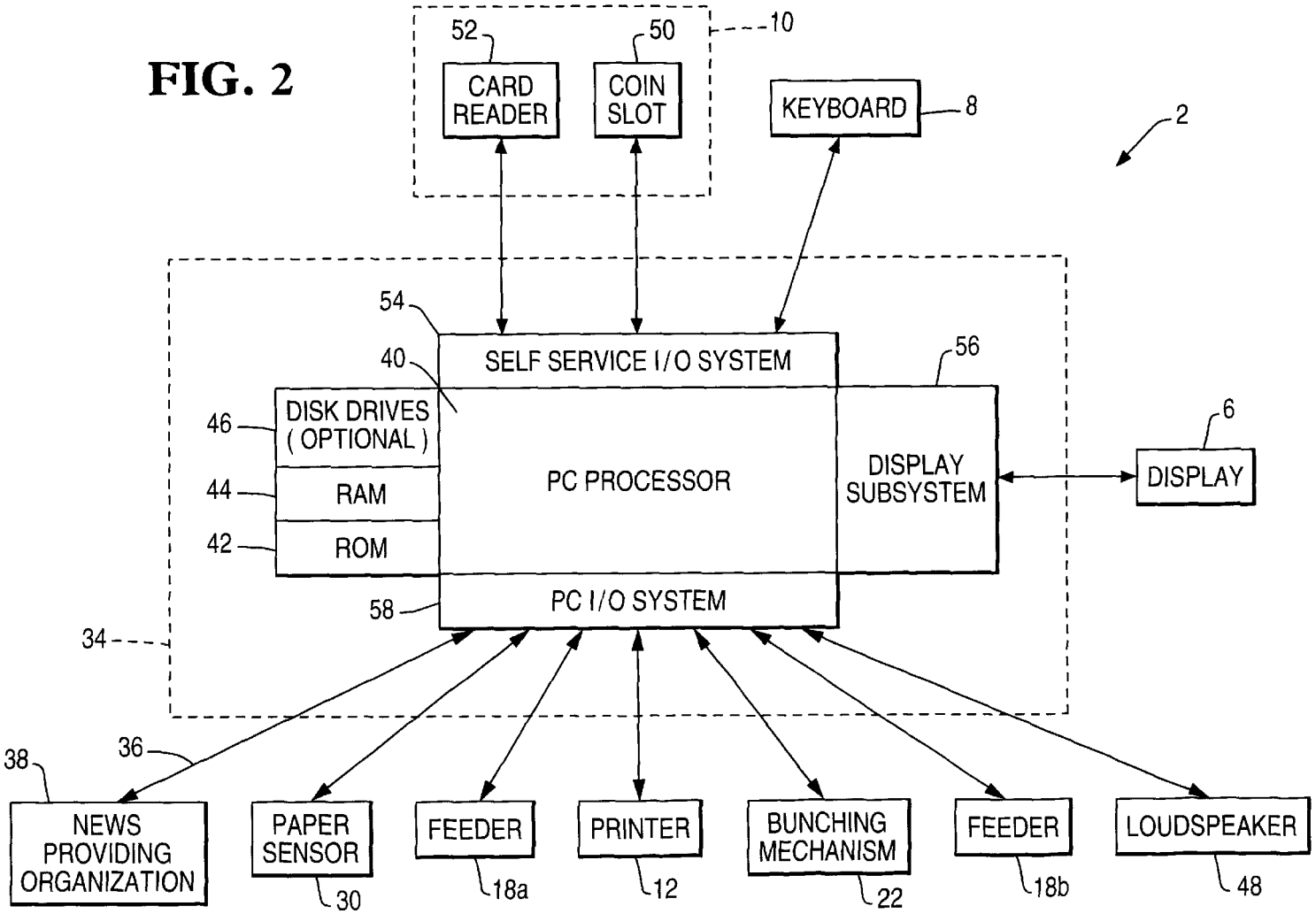
FIG. 2 is a block diagram of the control system of the self-service newspaper vending machine.

Turning now to FIG. 2, an electronic controller 34 is used to run the machine. In order for the vending machine to print out up to the minute information, the electronic controller 34 has an on-line connection 36 to a news providing organization 38. The on-line connection 36 may use the Public Switched Telephone Network (PSTN) with there being a modem (not shown) to provide the interface between the PSTN and the controller 34.

The controller 34 contains a PC processor 40 to provide the control, a ROM 42 and a RAM 44 for storing the information received from the news providing organization 38.

The PC processor 40 communicates with the keyboard 8 and a checking mechanism (not shown) associated with the payment slots 10 via a self-service Input/Output (I/O) system 54. The processor 40 communicates with the display 6 via a display subsystem 56. Also, the processor 40 communicates with the paper sensor 30, the printer 12, the bunching mechanism 22, the feeders 18*a*,18*b* and a loudspeaker 48 and receives on-line information from the news providing organization 38 via a PC I/O System 58.

News stories are displayed on the display 6 to attract the attention of passers-by. The loudspeaker 48 can also be incorporated into the vending machine 2, where sounds can be made that are related to the story displayed. This should hopefully increase the chances of a passer-by being attracted to the vending machine 2.

The electronic controller 34 controls what is displayed on the display 6 as well as controlling the sounds emitted by the loudspeaker 48. If a customer is interested in purchasing a newspaper or a relevant part of the newspaper, the controller 34 sends instructions to be displayed on the display 6. The loudspeaker 48 can be used to give verbal instruction in conjunction with the displayed instructions. The customer communicates his response back via a keyboard 8. The customer indicates what news he wants and the controller 34 displays on the display 6 the cost. The customer makes his payment via the payment slots 10.

Payment may be made by inserting coins or some form of banking or credit card into the appropriate one of the payment slots 10 with there being a coin slot 50 to accept coins and a card reader 52 to accept cards. Once it is communicated to the controller 34 that the correct payment has been made, the controller 34 then sends the required news to the printer 12 to be printed and activates the feeder 18*b* to transport the printed sheet or sheets to the opening 20 in the housing 4 for collection by the customer.

The card inserted into the card reader 52 may be of a type similar to a phone card which is purchased elsewhere and has a fixed number of units, initially stored on it. As purchases are made, the units stored on the card are reduced. If the card is of a type that needs connection to a banking system, this can be done via a modem connected to the PSTN.

Connection to the PSTN allows access to the Internet. The self-service vending machine 2 can have the facility for credit card transactions to be transacted over the Internet.

Impressive graphics could be displayed on the self-service newspaper vending machine 2. If this is required, it is far quicker for this type of information to be sent from the news providing organization 38 to the electronic control means 21 via a self-service communications network than via the PSTN. The self-service communications network would be governed by protocols such as Systems Network Architecture (SNA) or High Level Data Link Control (HDLC).

Whether the on-line connection 36 uses the PSTN or is formed from self-service communications, the connection to the PC processor 40 would be via the PC I/O system 58.

Storage capacity of the electronic controller 34 can be increased by increasing the size of the RAM 44 or by additionally including a disk drive 46 in the controller 34. The on-line connection 36 ensures that the stored information is continually updated.

The self-service newspaper vending machine 2 would give the customer the option of either buying the whole newspaper or just the page or pages that he is interested in such as the business pages or the sports news.

An advantage of the self-service newspaper vending machine over the traditional newspaper vending system is that the newspaper purchased contains up to the minute news. Also, distribution costs are reduced if a network of these vending machines is implemented as part of an overall newspaper vending system.

What is claimed is:

1. A self-service newspaper vending machine comprising:

data storage means for storing updated news items received from a source which provides on-line news information;

payment accepting means for accepting payment from a customer to allow the customer to select a number of updated news items stored in the data storage means;

selecting means for allowing a customer to select a number of updated news items stored in the data storage means to be printed;

paper storage means for storing sheets of paper on which selected updated news items can be printed;

printing means for printing selected updated news items onto sheets of paper from the paper storage means;

first feeding means for transporting sheets of paper from the paper storage means to the printing means;

second feeding means for transporting sheets of paper having selected updated news items printed thereon to a customer; and control means for (i) controlling the printing means to print selected updated news items onto sheets of paper from the paper storage means, and (ii) controlling the first and second feeding means to deliver the printed sheets to a customer in response to the customer selecting the updated news articles and making payment therefor.

2. A self-service newspaper vending machine according to claim 1, wherein the payment accepting means includes (i) a coin acceptor for receiving coins, and (ii) a card reader for receiving a payment card.

3. A self-service newspaper vending machine according to claim 2, wherein the payment card contains a magnetic strip.

4. A self-service newspaper vending machine according to claim 1, further comprising bunching means connected to the printing means and for joining printed sheets together.

5. A self-service newspaper vending machine according to claim 1, further comprising (i) a display, and (ii) at least one loudspeaker for emitting sounds relevant to information displayed on the display.

6. A self-service newspaper vending machine comprising:

a data storage unit for storing updated news items received from a source which provides on-line news information;

a payment acceptor unit for accepting payment from a customer to allow the customer to select a number of updated news items stored in the data storage unit;

a customer interface unit for allowing a customer to select a number of updated news items stored in the data storage unit to be printed;

a paper storage unit for storing sheets of paper on which selected updated news items can be printed;

a printer unit for printing selected updated news items onto sheets of paper from the paper storage unit;

a first sheet feeder for transporting sheets of paper from the paper storage unit to the printer unit to allow the printer unit to print a number of selected updated news items thereon;

a second sheet feeder for delivering sheets of paper having a number of selected updated news items printed thereon to a customer; and a controller for (i) controlling the first sheet feeder to transport sheets of paper from the paper storage unit to the printer unit, (ii) controlling the printer unit to print selected updated news items onto sheets of paper which have been transported from the paper storage unit to the printer unit, (iii) controlling the second sheet feeder to deliver the printed sheets to a customer in response to the customer selecting the updated news articles and making payment therefor.

7. A self-service newspaper vending machine according to claim 6, wherein the payment acceptor unit includes (i) a coin acceptor for receiving coins, and (ii) a card reader for receiving a payment card.

8. A self-service newspaper vending machine according to claim 7, wherein the payment card contains a magnetic strip.

9. A self-service newspaper vending machine according to claim 6, further comprising a buncher unit connected to the printer unit and for joining printed sheets together.

10. A self-service newspaper vending machine according to claim 6, further comprising (i) a display unit, and (ii) at least one loudspeaker unit for emitting sounds relevant to information displayed on the display unit.

11. A system comprising:

a source for providing on-line news information; and a number of self-service newspaper vending machines connectable on-line with the source and for, when connected on-line with the source, receiving on-line news information from the source;

each self-service newspaper vending machine including (i) data storage means for storing news items, (ii) processor means for updating at intervals the news items stored in the data storage means, (iii) payment accepting means for accepting payment from a user to enable a user to retrieve a news item from the data storage means, (iv) input means for enabling a user to request a news item to be retrieved from the data storage means, and (v) printing means for printing a news item which has been retrieved from the data storage means in response to a user requesting the news item and making payment therefor;

each self-service vending machine including a housing having a storage area for storing paper on which a news item is to be printed when the user requests the news item and makes payment therefor;

each self-service vending machine including a hollow pedestal having a storage area for storing additional paper, and feed means for feeding paper from the storage area of the hollow pedestal to the printing means when paper stored in the storage area of the housing has run out.

* * * * *